US008530529B2

(12) United States Patent
Wix

(10) Patent No.: US 8,530,529 B2
(45) Date of Patent: Sep. 10, 2013

(54) PROCESS FOR THE PRODUCTION OF SUBSTITUTE NATURAL GAS

(75) Inventor: Christian Wix, Virum (DK)

(73) Assignee: Haldor Topsoe A/S, Lyngby (DK)

( * ) Notice: Subject to any disclaimer, the term of this patent is extended or adjusted under 35 U.S.C. 154(b) by 424 days.

(21) Appl. No.: 12/763,785

(22) Filed: Apr. 20, 2010

(65) Prior Publication Data

US 2010/0286292 A1 Nov. 11, 2010

(30) Foreign Application Priority Data

May 7, 2009 (DK) ..... 2009 00590

(51) Int. Cl.
*C07C 27/00* (2006.01)

(52) U.S. Cl.
USPC ..... 518/702

(58) Field of Classification Search
USPC ..... 518/702
See application file for complete search history.

(56) References Cited

U.S. PATENT DOCUMENTS

| | | | |
|---|---|---|---|
| 3,709,669 | A | 1/1973 | Marion et al. |
| 3,890,113 | A | 6/1975 | Child et al. |
| 3,904,389 | A | 9/1975 | Banquy |
| 4,064,156 | A | 12/1977 | McRobbie |
| 4,124,628 | A | 11/1978 | McRobbie |
| 4,235,044 | A | 11/1980 | Cheung |
| 4,298,694 | A | 11/1981 | Skov |

FOREIGN PATENT DOCUMENTS

| | | | |
|---|---|---|---|
| GB | 1380276 | | 12/1971 |
| WO | WO 02/102943 | A1 | 12/2002 |
| WO | WO 2006/090218 | A1 | 8/2006 |
| WO | WO 2008/013790 | A2 | 1/2008 |
| WO | WO 2009/019497 | | 2/2009 |

*Primary Examiner* — Samantha Shterengarts
(74) *Attorney, Agent, or Firm* — Dickstein Shapiro LLP

(57) ABSTRACT

Process for the production of substitute natural gas (SNG) by the methanation of a synthesis gas derived from the gasification of a carbonaceous material together with water gas shift and carbon dioxide removal thereby producing a synthesis gas with a molar ratio $(H_2-CO_2)/(CO+CO_2)$ greater than 3.00. At the same time, a gas with a molar ratio $(H_2-CO_2)/(CO+CO_2)$ lower than 3.00 is added to the methanation section. The final product (SNG) is of constant high quality without excess of carbon dioxide and hydrogen.

10 Claims, 3 Drawing Sheets

PROCESS FOR THE PRODUCTION OF SUBSTITUTE NATURAL GAS

BACKGROUND OF THE INVENTION

1. Field of the Invention

The present invention relates to a process for the production of substitute natural gas (SNG) from carbonaceous materials. More particularly, the invention relates to a process for the production of SNG from a carbonaceous material in which the carbonaceous material is converted to a synthesis gas containing the right proportion of carbon monoxide, carbon dioxide and hydrogen for conducting a subsequent methanation while separately adding a gas stream having a molar ratio (H2−CO2)/(CO+CO2) lower than 3.00 to the methanation section of the plant. More particularly, this stream with molar ratio (H2−CO2)/(CO+CO2) lower than 3.00 is preferably a stream containing carbon dioxide withdrawn from the acid gas removal plant.

2. Description of the Related Art

The low availability of fossil liquid and gaseous fuels such oil and natural gas has revived the interest in developing technologies capable of producing natural gas synthetically from widely available resources such as coal, biomass as well as other alternative fuels such as black liquor, heavy oils and animal fats. The produced natural gas goes under the name substitute natural gas or synthetic natural gas (SNG) having methane as its main constituent.

The process of converting a reactant gas containing carbon oxides ($CO_2$, CO) and hydrogen to methane is commonly referred as methanation and represents a well-known technology which for instance has been used intensively in ammonia plants in order to remove carbon oxides, particularly carbon monoxides from the ammonia synthesis gas due to poisonous effect of carbon monoxide on the ammonia synthesis catalyst.

It is also known to produce SNG from a synthesis gas containing carbon oxides and hydrogen by the passage of such synthesis gas through a methanation section including one or more methanation reactors comprising a fixed bed of catalyst and where the synthesis gas is prepared by for instance gasification of the carbonaceous material.

The methanation process is governed by the reactions: $CO+3H_2=CH_4+H_2O$ and $CO_2+4H_2=CH_4+2H_2O$. Accordingly, methanation should be conducted at conditions that ensure a molar ratio $H_2/CO$ in the synthesis gas of 3 or 4. During the production of SNG it is often more convenient to operate with the stoichiometric number M defined by the molar ratio $M=(H_2-CO_2)/(CO+CO_2)$. The value of M in the synthesis gas to the methanation section has to be kept as close to 3.00 as possible. A gas with a value of M=3.00 is said to be stoichiometric, a gas with a value of M>3.00 is said to be over-stoichiometric and a gas with a value of M<3.00 is said to be under-stoichiometric.

The provision of a synthesis gas which is stoichiometric (M=3.00) is normally pursued by passing the gas from the gasification through a water gas shift (WGS) stage upstream the methanation section. During WGS carbon monoxide in the synthesis gas is converted under the presence of water to hydrogen and carbon dioxide. Prior to entering the methanation section the carbon dioxide in the synthesis gas produced in the WGS is normally removed by a conventional $CO_2$-wash, such as the Rectisol or Selexol process. Current methods of achieving molar ratios $(H_2-CO_2)/(CO+CO_2)$ as close to 3.00 as possible in the synthesis gas fed to the methanation section involve also some degree of bypassing of the water gas shift reactor. However, due to fluctuations during operation and the inherent dynamic behaviour of the plant which i.a. imply significant time-lags it is difficult to keep the molar ratio $(H_2-CO_2)/(CO+CO_2)$ of the synthesis gas used as feed gas for methanation close to the ideal value of 3.00, which is critical for the proper operation of the SNG plant. This conveys the problem that even small deviations from this value towards values higher or lower than 3.00 in the synthesis gas manifest itself in reduced quality of the final SNG product, since the product will contain inexpedient surplus of $CO_2$ and $H_2$. For instance, while the SNG product obtained from the methanation of a synthesis gas having M=3.00 may contain only 0.7 vol % $H_2$ and 0.4% $CO_2$, the SNG product from a synthesis gas with M=3.05 may contain 3 vol % $H_2$ and the SNG product of a gas with M=2.95 may contain 2 vol % $CO_2$. Hence, it would be desirable to be able to provide a process which properly controls the ratio $(H_2-CO_2)/(CO+CO_2)$ in order to obtain a final SNG product of constant high quality, i.e. a SNG product after the final methanation stage which contains above 90 volt $CH_4$, particularly above 95 vol % $CH_4$ with deviations of no more than 5%, less than 2 vol % $H_2$ and about 1.1 vol % or less of carbon oxides ($CO_2$ and CO) irrespective of the fluctuations experienced in the plant, particularly in the water gas shift stage (WGS).

According to the prior art the values of $(H_2-CO_2)/(CO+CO_2)$ or $H_2/CO$-ratio are conventionally adjusted by the use of membranes, by WGS followed by $CO_2$-removal, or by splitting streams upstream WGS with subsequent $CO_2$-removal.

Hence, WO-A-2006/09.0218 describes the use of membranes for the forming of hydrogen-adjusted synthesis gas streams during the production of a variety of synthetic hydrocarbons. This patent application is devoted to Fischer-Tropsch synthesis, DME and MeOH applications and to the adjustment of the $H_2/CO$ and $(H_2-CO_2)/(CO+CO_2)$ ratio of a synthesis gas produced by steam methane reforming and gasification.

U.S. Pat. No. 4,064,156 describes the methanation of synthesis gas in which the $H_2/CO$ ratio is adjusted by using an over-shifted feed gas having a $H_2/CO$ ratio above 3 or 4, i.e. above the stoichiometric ratio needed for methanation. Excess $CO_2$ in the feed gas is used as a diluent to absorb the heat evolved in the methanation reactor. Part of the excess $CO_2$ is removed prior to methanation by conventional acid gas wash.

U.S. Pat. No. 4,124,628 discloses a methanation process comprising gasification, optionally water gas shift, $CO_2$-removal and methanation, the latter being conducted in six stages and with $CO_2$ removal in between the 5th and 6th methanation stage.

U.S. Pat. No. 4,235,044 deals with the issue of fluctuations in feed gas rate in continuous operations for the production of methane. The ratio $H_2/CO$ is regulated by splitting the syngas stream upstream the water gas shift (WGS) section. Part of the stream not passed through WGS serves to adjust the $H_2/CO$ ratio of the WGS treated stream, thereby resulting in a high $H_2/CO$ ratio in the gas to the methanation reactors. A purified stream from the gasification may be diverted and added directly to a second methanation reactor with $CO_2$ removal being conducted after this reactor.

WO-A-2008/013790 discloses the conversion of carbon to SNG via steam reforming and methanation. In the acid gas scrubbing (AGS) zone it may be desirable to leave a certain amount of $CO_2$ in the scrubbed stream used as feed gas for methanation depending on the end use of the methane, e.g. as pipeline gas or as raw material for MeOH synthesis.

WO-A-02/102943 discloses a methanation process in which $H_2$ or $CO_2$ are separated from the methane product by use of membranes or pressure swing adsorption (PSA) and in which $H_2$ is recycled to the synthesis gas feed.

Our U.S. Pat. No. 4,298,694 describes methanation of syngas from gasification and purification stages and which is divided in two part streams, one of which is methanised in an adiabatic methanation reactor and subsequently unified with the other part stream. The combined stream is then added to a cooled methanation reactor.

SUMMARY OF THE INVENTION

We have now found that by providing a process in which the synthesis gas for the methanation section is produced by the sequential steps of gasification, water gas shift and acid gas removal while separately adding a gas with M<3.00, i.e. an under-stoichiometric gas, to the methanation section it is now possible to obtain a final SNG product of constant high quality.

Consistent with the description above, by a final SNG product of constant high quality is meant a SNG product having a methane content above 90 vol % in which the content of the components methane, carbon monoxide, carbon dioxide and hydrogen is kept constant without excess of carbon dioxide and hydrogen and within the narrow ranges 10-25 ppmv CO; less than 1.1 vol % $CO_2$, particularly in the range 0.1-1.1 vol % $CO_2$; less than 2 vol % $H_2$, particularly in the range 0.5-2 vol % $H_2$, and the content of methane is above 90 vol % with deviations of no more than 5%, preferably deviations of no more than 2-3%, such as 91-93 vol % $CH_4$ or 95-98 vol % $CH_4$.

Accordingly, we provide a process for the production of substitute natural gas (SNG) by the methanation of a synthesis gas derived from the gasification of a carbonaceous material, the process comprising the steps of:

(a) passing the carbonaceous material through a gasification stage and withdrawing a gas containing carbon monoxide, carbon dioxide and hydrogen;

(b) passing at least a portion of the gas from the gasification stage through a water gas shift stage and withdrawing a gas enriched in hydrogen;

(c) passing the gas from step (b) through an acid gas removal step, withdrawing a stream of carbon dioxide and withdrawing a stream of synthesis gas containing hydrogen, carbon dioxide and carbon monoxide and with a molar ratio $M=(H_2-CO_2)/(CO+CO_2)$ greater than 3.00;

(d) passing the synthesis gas from step (c) through a methanation section containing at least one methanation reactor and withdrawing from the methanation section a product gas containing methane;

(e) adding to the methanation section of step (d) a stream having a molar ratio $M=(H_2-CO_2)/(CO+CO_2)$ lower than 3.00 which is selected from the group consisting of a stream derived from the gas withdrawn in step (a), a stream derived from the gas withdrawn in step (b), a stream at least partly derived from the stream of carbon dioxide withdrawn in step (c), a separate stream containing at least 80 volt $CO_2$, and combinations thereof.

Consistent with the definition above, the product gas containing methane in step (d) contains preferably at least 90 volt methane, more preferably at least 95 vol % methane, most preferably at least 97 vol % methane.

In a specific embodiment the gas withdrawn in step (a) has a molar ratio $M=(H_2-CO_2)/(CO+CO_2)$ in the range 0.06-0.80. For instance, a value of 0.06 corresponds to a gas obtained from the gasification of black liquor.

Hence, by a simple and unconventional way of controlling the molar ratio $(H_2-CO)/(CO+CO_2)$ which involves slightly over-shifting the gas in the WGS stage, i.e. molar ratio $M=(H_2-CO)/(CO+CO_2)$ of above 3.00 and adding an under-stoichiometric gas (M<3.00) to the methanation section it is now possible to obtain a product gas SNG of constant high quality. The process becomes significantly more robust to fluctuations in the water gas shift stage and in addition the methanation process itself in the methanation section of the plant becomes easier to conduct due to the hydrogen surplus in the synthesis gas.

We have also found that by adding said under-stoichiometric stream (M<3.00) to the methanation section and at the same time letting the molar ratio $(H_2-CO_2)/(CO+CO_2)$ of the synthesis gas obtained after WGS and $CO_2$-wash increase to values only slightly above the ideal value of 3.00, it is now possible to further increase the SNG production, to further improve the robustness of the process and thereby to further ensure a final SNG product of constant high quality. Accordingly, in a specific embodiment of the invention the synthesis gas from step (c) has a molar ratio $(H_2-CO_2)/(CO+CO_2)$ greater than 3.00 and below 3.30, preferably in the range 3.10 to 3.20.

As used herein the term "passing at least a portion of the gas from the gasification stage through a water gas shift stage" means that some of the gas from the gasification stage may by-pass the water gas shift stage. The bypass gas may then be combined with the effluent gas from the water gas shift stage.

As used herein the term "methanation section" defines the section of the SNG plant downstream the $CO_2$-wash, and comprises at least one methanation reactor, water removal units particularly for depletion of water in the effluents withdrawn from the penultimate and last methanation reactors, and optionally a sulphur guard upstream the methanation reactors or immediately downstream the $CO_2$-wash unit such as a fixed bed of zinc oxide.

As used herein the term "synthesis gas" defines a feed gas stream containing carbon monoxide, carbon dioxide and hydrogen produced after the acid gas removal step and that is used as feed gas in the methanation section and consequently is used in either reactor of the methanation section. Accordingly, as used herein the process gas containing mainly $H_2$, CO and small amounts of $CO_2$ withdrawn from the $CO_2$-wash downstream the WGS stage represents a synthesis gas as also is a feed gas entering any of the methanation reactors of the methanation section of the plant.

As used herein the terms "acid gas removal" and "$CO_2$-wash" are used interchangeably.

While the stream which is at least partly derived from the stream of carbon dioxide withdrawn in step (c), i.e. from the acid gas removal step, often requires compression upon introduction into the methanation section, the gas withdrawn from step (a), i.e. from the gasification stage, and the gas withdrawn from step (b), i.e. from the WGS stage require no such compression. Significant savings in compression energy can therefore be achieved when using gas from the gasification and WGS stage.

As used herein the term "a stream at least partly derived from the stream of carbon dioxide withdrawn in step (c)" encompasses not only a stream representing a portion of said stream of carbon dioxide but also the total stream, i.e. the whole stream of carbon dioxide withdrawn in step (c).

As used herein the term "a separate stream containing at least 80 vol % $CO_2$" defines any stream which is not derived directly from the SNG process involving gasification of carbonaceous material through methanation, but which comes from other separate processes where there is excess of carbon dioxide.

It would be understood that conventionally the gas generated during water gas shift contains excess carbon dioxide, most of which needs to be removed and disposed of. If not removed after the water gas shift the $CO_2$ will have to be removed later on in the methanation section, otherwise the final product gas SNG will contain high amounts of $CO_2$ which reduce the value of the product. In a specific embodiment of the invention, a stream with molar ratio M<3.00, preferably carbon dioxide removed in the $CO_2$-wash before methanation, more preferably the whole stream of carbon dioxide withdrawn in step (c), i.e. the $CO_2$-stream removed during the acid gas removal step ($CO_2$-wash) is actually added to the process again in the methanation section. This is highly counterintuitive because $CO_2$ is unwanted in the final product, yet by providing this simple and untraditional measure we are able to control the methanation process so that the final SNG product reflects the use of a gas with ideal molar ratio $M=(H_2-CO_2)/(CO+CO_2)$ of 3.00 in the synthesis gas to the methanation section produced after the water gas shift and $CO_2$-wash.

In yet another specific embodiment of the invention said stream with molar ratio $M=(H_2-CO_2)/(CO+CO_2)$ lower than 3.00, particularly gas from the gasification stage and/or from the water gas shift stage, is subjected to desulfurisation before adding the stream to the methanation section.

The WGS stage is preferably conducted in a fixed bed reactor of conventional water gas shift catalyst or sour shift catalyst.

In a specific embodiment of the process the methanation section of step (d) comprises passing the synthesis gas through at least two methanation reactors containing a catalyst active in methanation. Preferably all the methanation reactors are adiabatic reactors containing a fixed bed of methanation catalyst with coolers arranged in between the reactors to bring the exothermic methanation reactions under favourable thermodynamical conditions, i.e. low temperatures. The methanation reactors may also be provided in the form of fluidised beds containing the methanation catalysts.

The synthesis gas after the $CO_2$-wash is preferably admixed with steam and if desired passed through a sulphur guard bed in order to remove sulphur components to well below 1 ppm, since these components are poisonous to the methanation catalyst. The synthesis gas is then added to the first and second methanation reactors by admixing a portion of the synthesis gas with a recycle stream derived from the effluent of the first methanation reactor thereby providing the feed gas to the first methanation reactor and by admixing another portion of the synthesis gas with a portion of the effluent stream of the first methanation reactor thereby providing the feed gas to the second methanation reactor. The recycle stream derived from the effluent of the first methanation reactor acts as a diluent and enables absorption of some of heat generated in the first methanation reactor. The effluent streams from the second and subsequent methanation reactors are preferably added to each subsequent methanation reactor in a series arrangement. In other words, the effluent from the second methanation reactor, which represents the synthesis gas or feed gas to the subsequent third methanation reactor, is added directly to the latter; the effluent from the third methanation reactor is added directly to the fourth methanation reactor and so forth. By "added directly" is meant without being combined with other process gas streams.

In a further embodiment of the invention a recycle stream is derived from the effluent stream of the last methanation reactor and this recycle stream is admixed with the effluent stream passed to said last methanation reactor. In yet another specific embodiment the stream added to the methanation section and having a molar ratio $(H_2-CO_2)/(CO+CO_2)$ lower than 3.00 is combined with the recycle stream of said last methanation reactor.

As mentioned above, the stream having a molar ratio $(H_2-CO_2)/(CO+CO_2)$ lower than 3.00 is preferably the stream withdrawn from the $CO_2$-wash upstream the methanation section. The addition of this $CO_2$ stream to the last methanation reactor enables a simpler control of the final SNG product obtained downstream after water removal so it reflects a molar ratio $(H_2-CO_2)/(CO+CO_2)$ of 3.00 in the synthesis gas obtained from the $CO_2$-wash upstream the methanation section.

Steam is normally added to the synthesis gas entering the methanation section, specifically the synthesis gas being conducted to the first methanation reactor despite of the fact that steam reverses the equilibrium of the methanation reactions away from the desired product methane. Steam is necessary in order to reduce the propensity of undesired carbon formation due to the presence of carbon monoxide in the synthesis gas. Under the presence of steam the methanation reactions $CO+3H_2=CH_4+H_2O$ and $CO_2+4H_2=CH_4+2H_2O$ will be accompanied by the conversion of carbon monoxide to carbon dioxide under the production of hydrogen and carbon dioxide (water gas shift) according to the reaction $CO+H_2O=H_2+CO_2$. Carbon can be formed by direct decomposition of methane to carbon according to the reaction $CH_4=C+2H_2$ or by the Boudouard reaction $2CO=C+CO_2$. The production of $CO_2$ enables therefore that the Boudouard reaction is shifted to the left thereby preventing the production of carbon.

The amount of steam used in the methanation section can be rather significant and it also implies the use of large equipment size. By the invention, the amount of water steam used in the methanation section is significantly reduced and at the same time it is possible to operate at conditions where undesired carbon formation is prevented.

The carbonaceous material used in the gasification may encompass a variety of materials, but preferably the carbonaceous material is selected from the group consisting of coal, petcoke, biomass, oil such as heavy oil, black liquor, animal fat and combinations thereof.

DETAILED DESCRIPTION OF THE PREFERRED EMBODIMENTS

Figure 1:
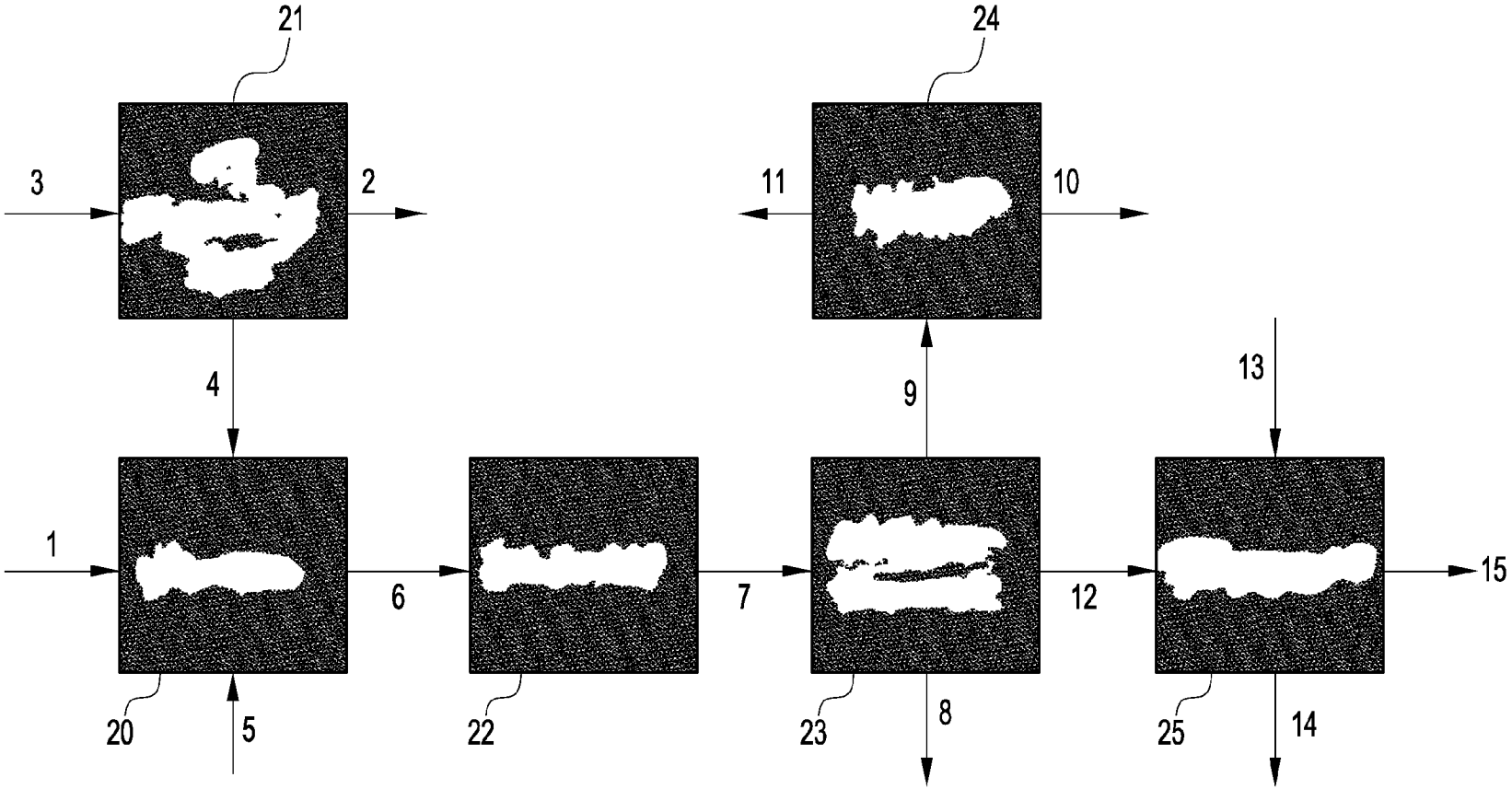
FIG. 1 shows a simplified block diagram of the general process according to the invention including gasification of carbonaceous material, water gas shift, acid gas removal and methanation section.

Referring to FIG. 1, carbonaceous material is added in stream 1 to gasifier 20. Air 3 is introduced into Air Separation Unit 21 to produce oxygen stream 4 which is introduced to gasifier 20 together with steam 5. The gasification of the carbonaceous material produces a gas 6 containing carbon monoxide, carbon dioxide and hydrogen which is added to sour shift reactor 22 under the production of hydrogen and carbon dioxide in a gas which is withdrawn as stream 7 and which is subsequently subjected to a $CO_2$-wash in acid gas removal plant 23 such as a Rectisol or Selexol plant. A portion of the stream 6 may bypass the shift reactor 22 and then be combined with exit stream 7. Carbon dioxide is removed as stream 8 while stream 9 containing $CO_2/H_2S$ is conducted to a gas treatment plant 24 under production of sulphuric acid 10 and steam 11. The scrubbed gas stream 12 from the acid gas removal plant 23 having a molar ratio $(H_2-CO_2)/(CO+CO_2)$ greater than 3.00, preferably in the range 3.00-3.30, such as in the range 3.05-3.30 represents the synthesis gas or feed gas to the methanation section 25. A gas 13 containing at least 80 vol % $CO_2$ such as $CO_2$ stream 8 is introduced into this section under the production of steam 14 and a final substitute natural gas (SNG) 15 of constant high quality and less sensitive to fluctuations in the water gas shift stage 22 upstream the methanation section.

Figure 2:
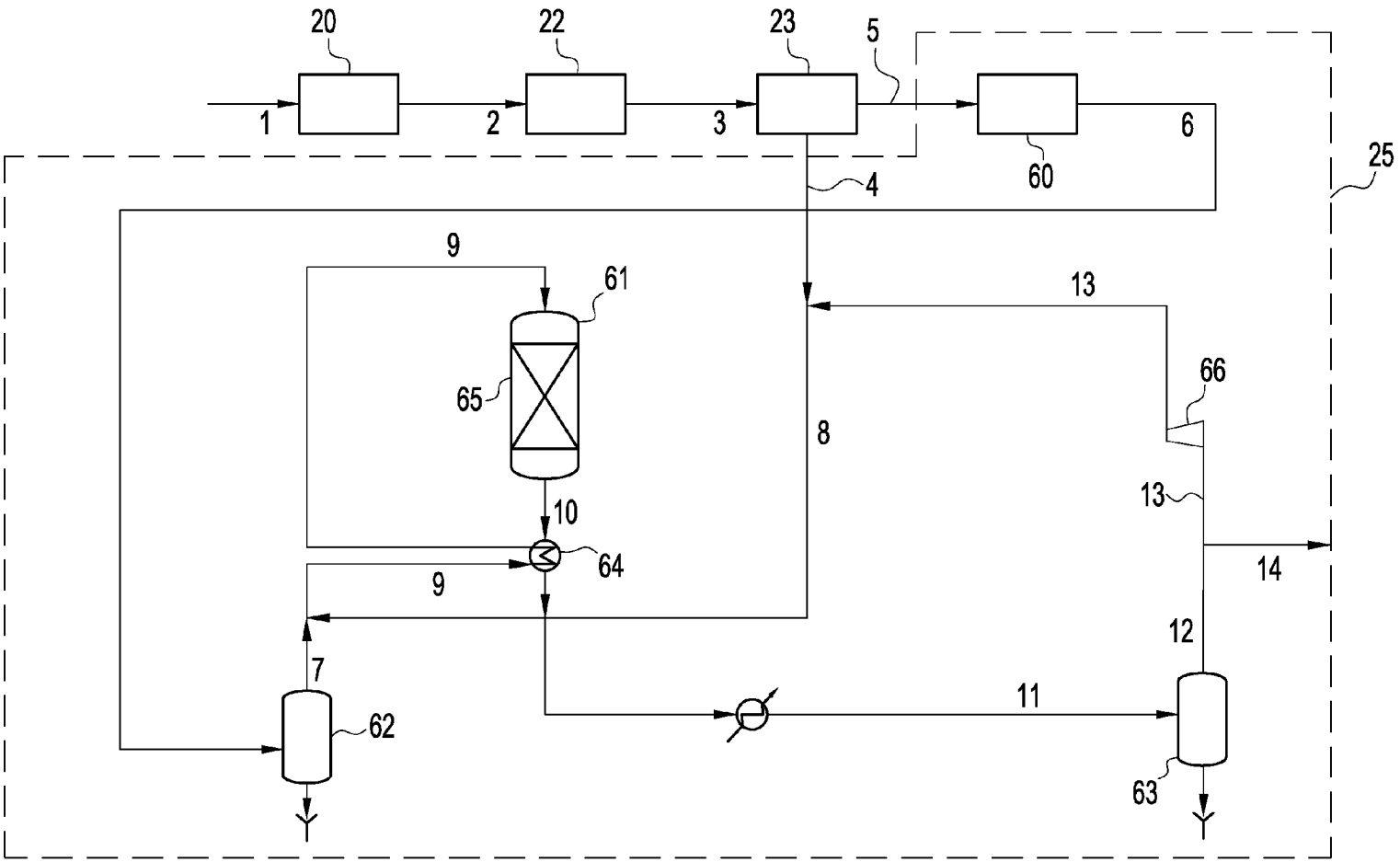
FIG. 2 shows the process of FIG. 1 with addition of carbon dioxide from the acid gas removal step into the last methanation reactor of the methanation section (block 25).

Referring to FIG. 2, similarly to FIG. 1 carbonaceous material is added in stream 1 to gasifier 20. Table 1 shows mass balance data of the main streams involved. The gasification of the carbonaceous material produces a gas 2 containing carbon monoxide, carbon dioxide and hydrogen which is added to sour shift reactor 22 under the production of hydrogen and carbon dioxide in a gas which is withdrawn as stream 3 and which is subsequently subjected to a $CO_2$-wash in acid gas removal plant 23 such as a Rectisol or Selexol plant. Carbon dioxide is removed as stream 4, while the scrubbed gas stream 5 from the acid gas removal plant 23 having a molar ratio $(H_2-CO_2)/(CO+CO_2)$ of 3.05 represents the synthesis gas or feed gas to the methanation section 25. This synthesis gas stream 5 is subjected to so-called bulk methanation 60 in four adiabatic methanation reactors resulting in gas stream 6 containing about 80 vol methane. Water and other impurities in gas stream 6 are then removed in first separator 62 upstream the fifth methanation reactor 61 and second separator 63 downstream this reactor. From the first separator 62 an overhead stream 7 is withdrawn which is admixed with final recycle stream 8 to form a synthesis gas stream or feed gas 9. Final recycle stream 8 is obtained by combining stream 4 with a first recycle stream 13 from the last methanation reactor 61. Stream 9 is heated in feed-effluent heat exchanger 64 and then conducted to the last methanation reactor 61 having a fixed bed of methanation catalyst 65 arranged therein. The effluent 10 from this reactor is cooled in said heat exchanger 64 to form stream 11 which is passed to separator 63. The overhead stream 12 from this separator is subsequently divided into final SNG product 14 and first recycle stream 13 which is driven by recycle compressor 66. Stream 4 containing at least 80 volt $CO_2$, more specifically the $CO_2$-stream withdrawn from the acid gas removal plant upstream the methanation section (stream 8 in FIG. 1) is added to first recycle stream 13, thereby finely adjusting the synthesis gas 9 added to the last methanation reactor 61 so that the final SNG product 14 reflects the use of a synthesis gas 5 for methanation having the ideal molar ratio $M=(H_2-CO_2)/(CO+CO_2)$ of 3.00. This SNG product is of constant high quality as the content of the most relevant components methane, carbon monoxide, carbon dioxide and hydrogen are constantly kept within narrow ranges, here 91-93 vol % $CH_4$, here about 91.5 volt $CH_4$; 10-25 ppmv CO, here about 20 ppmv; less than 1.1 volt $CO_2$, here about 1.05 volt, and less than 2 vol % $H_2$, here about 0.4 vol % $H_2$.

TABLE 1

Mass balance for process of FIG. 2

| | Streams | | | | | |
|---|---|---|---|---|---|---|
| | 2 | | 3 | | 4 | |
| | Nm3/h | Mole % | Nm3/h | Mole % | Nm3/h | Mole |
| Ar | 1700 | 1.04 | 1700 | 0.73 | | |
| CH4 | | | | | | |
| CO | 106619 | 65.18 | 37180 | 15.96 | | |
| CO2 | 3401 | 2.08 | 72839 | 31.26 | 897 | 100 |
| H2 | 50504 | 30.87 | 119942 | 51.47 | | |
| N2 | 1360 | 0.83 | 1360 | 0.58 | | |
| H2O | | | 148872 | | | |
| DRY | | | 233022 | 100 | 897 | 100 |
| TOTAL | 163584 | 100 | 381893 | | 897 | |
| MOLE WEIGHT | 20.44 | | 19.05 | | 44.01 | |

| | Streams | | | | | | | |
|---|---|---|---|---|---|---|---|---|
| | 5 | | 6 | | 9 | | 14 | |
| | Nm3/h | Mole % | Nm3/h | Mole % | Nm3/h | Mole % | Nm3/h | Mole % |
| Ar | 1700 | 1.05 | 1700 | 3.70 | 2367 | 3.72 | 1699 | 3.96 |
| CH4 | | | 38237 | 83.19 | 53644 | 84.21 | 39208 | 91.45 |
| CO | 37168 | 22.98 | 4 | 94 ppm | 5 | 73 ppm | 1 | 21 ppm |
| CO2 | 1617 | 1.00 | 544 | 1.18 | 1613 | 2.53 | 449 | 1.05 |
| H2 | 119902 | 74.13 | 4118 | 8.96 | 4179 | 6.56 | 159 | 0.37 |
| N2 | 1360 | 0.84 | 1360 | 2.96 | 1895 | 2.97 | 1360 | 3.17 |
| H2O | | | 39310 | | 462 | | 97 | |
| DRY | 161747 | 100 | 45963 | 100 | 63703 | 100 | 42876 | 100 |
| TOTAL | 161747 | | 85273 | | 64165 | | 42973 | |
| MOLE WEIGHT | 9.03 | | 17.12 | | 17.08 | | 17.61 | |

Figure 3:
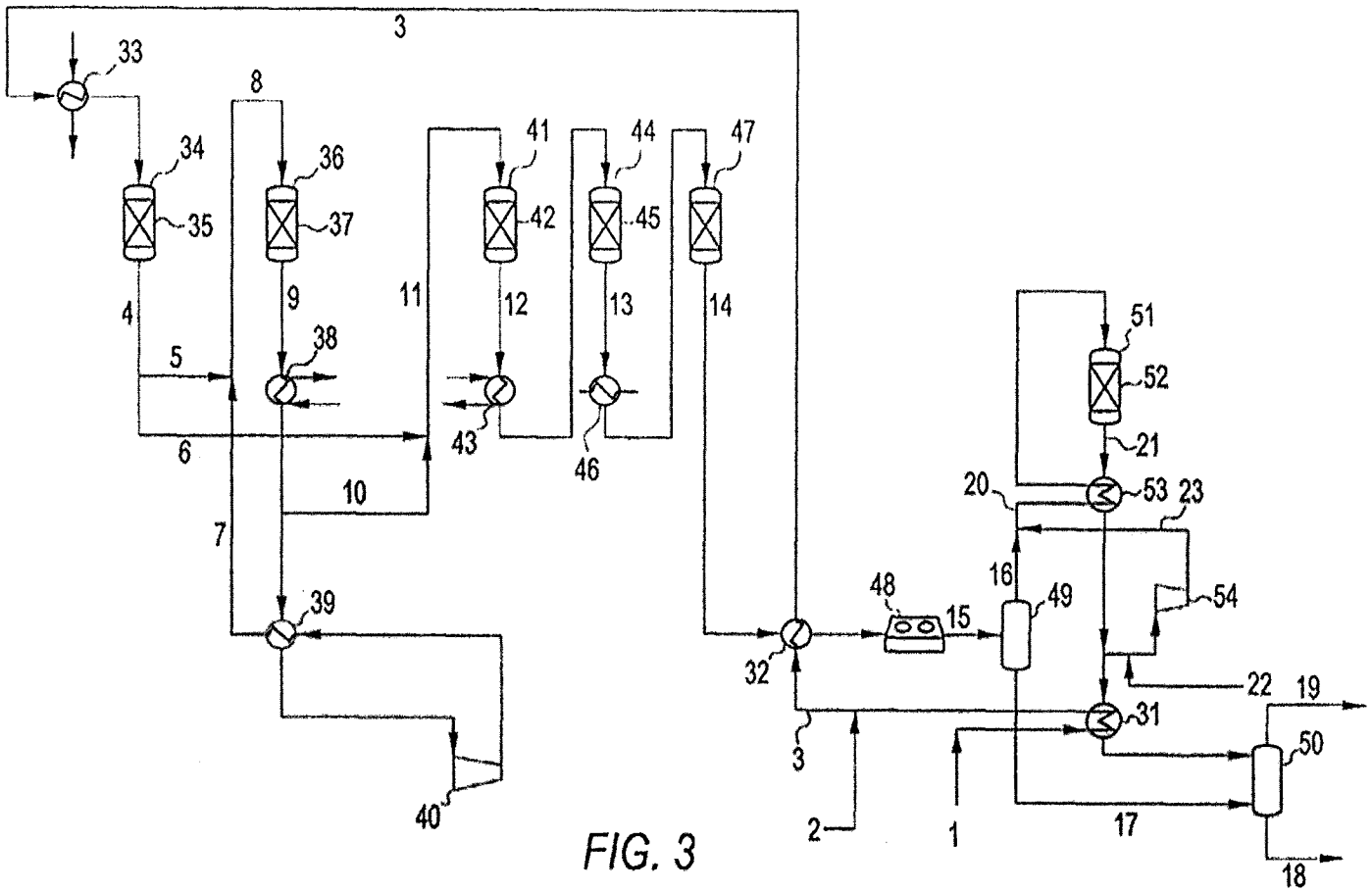
FIG. 3 shows another particular embodiment of the methanation section (block 25) of the process of FIG. 1 with addition of carbon dioxide from the acid gas removal step into the last methanation reactor.

Referring now to FIG. 3, a synthesis gas stream or feed gas 1 (which corresponds to stream 12 in FIG. 1) from an acid gas removal plant upstream is preheated in heat exchanger 31 and admixed with steam 2. The combined synthesis gas stream 3 for methanation is further heated in feed-effluent heat exchanger 32 and again in heat exchanger 33 prior to passing the synthesis gas through sulphur guard unit 34 containing a fixed bed 35 of sulphur adsorbent. The sulphur depleted synthesis gas 4 is divided into synthesis gas substreams 5 and 6 which are added respectively to a first methanation reactor 36 and second methanation reactor 41 each containing a fixed bed of methanation catalyst 37, 42.

Synthesis gas sub-stream 5 is combined with recycle stream 7 from the first methanation reactor 36 to form a synthesis gas stream 8 which used as feed gas to this reactor. The effluent stream 9 from the first methanation reactor 36 is cooled in waste heat boiler 38 and feed-effluent heat exchanger 39 and subsequently passed through recycle compressor 40 where recycle stream 7 is generated. Synthesis gas sub-stream 6 is admixed with a sub-stream 10 derived from the effluent 9 of the first methanation reactor 36 to form a combined stream 11 which is then passed to subsequent methanation reactors arranged in series. Effluent 12 from second methanation reactor 41 is cooled in waste heat boiler 43. This cooled effluent, now representing the synthesis gas or feed gas to the third methanation reactor 44 containing a fixed bed of methanation catalyst 45 is passed there through to produce an effluent 13 which is cooled in steam superheater 46 and subsequently passed through a fourth methanation reactor 47. The effluent 14 from this fourth reactor is then cooled by passage through feed-effluent heat exchanger 32 and air cooler 48. Water and other impurities in the gas stream 15 are then removed in first separator 49 upstream the fifth and last methanation reactor 51 and second separator 50 downstream this reactor. From the first separator 49 an overhead stream 16 is withdrawn which is admixed with a recycle stream 23 from the last methanation reactor to form a synthesis gas stream or feed gas 20. This stream 20 is heated in feed-effluent heat exchanger 53 and then conducted to said fifth and last methanation reactor 51 having arranged therein a fixed bed of methanation catalyst 52. The effluent 21 from this reactor is cooled in said heat exchanger 53 and is subsequently divided to form said recycle stream 23 which is driven by recycle compressor 54. A stream 22 containing at least 80 vol % $CO_2$, more specifically the $CO_2$-stream withdrawn from the acid gas removal plant upstream the methanation section (stream 8 in FIG. 1) is added to recycle stream 23, thereby finely adjusting the synthesis gas 20 added to this reactor so that the final SNG product 19 reflects the use of a synthesis gas 1 having the ideal molar ratio $M=(H_2-CO_2)/(CO+CO_2)$ of 3.00. The cooled stream from the last methanation reactor 51 is passed to second separator 50 for final removal of water which is retrieved as stream 18. The overhead stream 19 represents the final SNG product ready to be compressed for downstream uses. This SNG product is of constant high quality having a methane content above 90 vol %, here 95-98 vol % $CH_4$, more specifically about 97 vol % $CH_4$; and with the content of the most relevant components methane, carbon monoxide, carbon dioxide and hydrogen being kept constantly within narrow ranges: 10-25 ppmv CO, here about 13 ppmv; less than 1.1 vol % $CO_2$, here about 0.4 vol %, and less than 2.0 vol % $H_2$, here specifically about 1 vol % $H_2$.

What is claimed is:

1. Process for the production of substitute natural gas (SNG) by the methanation of a synthesis gas derived from the gasification of a carbonaceous material, the process comprising the steps of:

(a) passing the carbonaceous material through a gasification stage and withdrawing a gas containing carbon monoxide, carbon dioxide and hydrogen;

(b) passing at least a portion of the gas from the gasification stage through a water gas shift stage and withdrawing a gas enriched in hydrogen;

(c) passing the gas from step (b) through an acid gas removal step, withdrawing a stream of carbon dioxide and withdrawing a stream of synthesis gas containing hydrogen, carbon dioxide and carbon monoxide and with a molar ratio M=(H2−CO2)/(CO+CO2) greater than 3.00;

(d) passing the synthesis gas from step (c) through a methanation section containing at least one methanation reactor and withdrawing from the methanation section a product gas containing methane;

(e) adding to the methanation section of step (d) a stream having a molar ratio M=(H2−CO2)/(CO+CO2) lower than 3.00 which is selected from the group consisting of a stream derived from the gas withdrawn in step (a), a stream derived from the gas withdrawn in step (b), a stream at least partly derived from the stream of carbon dioxide withdrawn in step (c), a separate stream containing at least 80 vol % CO2, and combinations thereof.

2. Process according to claim 1, wherein the synthesis gas from step (c) has a molar ratio (H2−CO2)/(CO+CO2) greater than 3.00 and below 3.30.

3. Process according to claim 1, wherein the stream with molar ratio M=(H2−CO2)/(CO+CO2) lower than 3.00 as recited in step (e) is the whole stream of carbon dioxide withdrawn in step (c).

4. Process according to any of claims 1 to 3, wherein said stream with molar ratio M=(H2−CO2)/(CO+CO2) lower than 3.00 as recited in step (e) is subjected to desulfurisation before adding the stream to the methanation section.

5. Process according to claim 1, in which the methanation section of step (d) comprises passing the synthesis gas through a series of at least two methanation reactors containing a catalyst active in methanation.

6. Process according to claim 5, wherein the synthesis gas from step (c) is admixed with steam and then added to the first and second methanation reactors by admixing a portion of the synthesis gas with a recycle stream derived from the effluent of the first methanation reactor thereby providing the feed gas to the first methanation reactor and by admixing another portion of said synthesis gas with a portion of the effluent stream of the first methanation reactor thereby providing the feed gas to the second methanation reactor, and wherein the effluent streams from the second and subsequent methanation reactors are added to each subsequent methanation reactor in a series arrangement.

7. Process according to claim 5, wherein a recycle stream is derived from the effluent stream of the last methanation reactor and this recycle stream is admixed with the effluent stream passed to said last methanation reactor.

8. Process according to claim 7, wherein the stream added to the methanation section as recited in step (e) and having a molar ratio (H2−CO2)/(CO+CO2) lower than 3.00 is combined with the recycle stream of said last methanation reactor.

9. Process according to claim 1, wherein the carbonaceous material is selected from the group consisting of coal, petcoke, biomass, oil, black liquor, animal fat and combinations thereof.

10. Process for the production of substitute natural gas (SNG) by the methanation of a synthesis gas derived from the gasification of a carbonaceous material, the process comprising the steps of:

(a) passing the carbonaceous material through a gasification stage and withdrawing a gas containing carbon monoxide, carbon dioxide and hydrogen;

(b) passing at least a portion of the gas from the gasification stage through a water gas shift stage and withdrawing a gas enriched in hydrogen;

(c) passing the gas from step (b) through an acid gas removal step, withdrawing a stream of carbon dioxide and withdrawing a stream of synthesis gas containing hydrogen, carbon dioxide and carbon monoxide and with a molar ratio $M=(H_2-CO_2)/(CO+CO_2)$ greater than 3.00;

(d) passing the synthesis gas from step (c) through a methanation section containing at least one methanation reactor and withdrawing from the methanation section a product gas containing methane;

(e) adding to the product gas from the methanation section of step (d) a stream having a molar ratio $M=(H_2-CO_2)/(CO+CO_2)$ lower than 3.00 which is selected from the group consisting of a stream de-rived from the gas withdrawn in step (a), a stream derived from the gas withdrawn in step (b), a stream at least partly derived from the stream of carbon dioxide withdrawn in step (c), a separate stream containing at least 80 vol % $CO_2$, and combinations thereof; and, (f) directing the combined stream of (e) to a last methanator.

* * * * *